US006783909B2

(12) United States Patent
Kawanishi et al.

(10) Patent No.: US 6,783,909 B2
(45) Date of Patent: Aug. 31, 2004

(54) ELECTROSTATIC IMAGE DEVELOPING TONER AND IMAGE FORMING METHOD

(75) Inventors: Tsuneaki Kawanishi, Ibaraki (JP); Ryuuichi Shimizu, Ibaraki (JP); Shigenori Yaguchi, Ibaraki (JP); Junji Kobayashi, Ibaraki (JP); Tadahiro Kaneko, Ibaraki (JP); Nobuyoshi Hoshi, Ibaraki (JP)

(73) Assignee: Hitachi Printing Solutions, Ltd., Ebina (JP)

( * ) Notice: Subject to any disclaimer, the term of this patent is extended or adjusted under 35 U.S.C. 154(b) by 50 days.

(21) Appl. No.: 10/339,568

(22) Filed: Jan. 10, 2003

(65) Prior Publication Data

US 2003/0134216 A1 Jul. 17, 2003

(30) Foreign Application Priority Data

Jan. 11, 2002 (JP) ..... P. 2002-005263
Aug. 9, 2002 (JP) ..... P. 2002-233402

(51) Int. Cl.[7] ..... G03G 9/00
(52) U.S. Cl. ..... 430/108.8; 430/111.4
(58) Field of Search ..... 430/108.8, 111.4

(56) References Cited

U.S. PATENT DOCUMENTS 6,156,470 A * 12/2000 Matsunaga et al. ..... 430/108.3
6,653,038 B2 * 11/2003 Matsunaga et al. .... 430/108.22
2002/0022189 A1 * 2/2002 Kawanishi et al. ..... 430/108.8

FOREIGN PATENT DOCUMENTS

| | | |
|---|---|---|
| JP | 52-3304 | 1/1977 |
| JP | 52-3305 | 1/1977 |
| JP | 57-52574 | 3/1982 |
| JP | 5-313413 | 11/1993 |
| JP | 6-324513 | 11/1994 |
| JP | 7-036218 | 2/1995 |
| JP | 7-209909 | 8/1995 |
| JP | 7-287413 | 10/1995 |
| JP | 7-287418 | 10/1995 |
| JP | 8-114942 | 5/1996 |
| JP | 8-314181 | 11/1996 |
| JP | 9-179335 | 7/1997 |
| JP | 9-281748 | 10/1997 |
| JP | 9-304966 | 11/1997 |
| JP | 9-319139 | 12/1997 |

* cited by examiner

*Primary Examiner*—Mark A. Chapman
(74) *Attorney, Agent, or Firm*—McGinn & Gibb, PLLC

(57) ABSTRACT

Electrostatic image developing toner includes fixing resin; and wax. The wax is hydrocarbon-based wax. The wax is containing, as its constitutional components, first wax and second wax. The first wax is higher than 1.5 in ratio of weight average molecular weight (Mw) to number average molecular weight (Mn), lower than 10 mPa·s in melt viscosity at 140° C. and higher than 75% and not higher than 85% in degree of crystallinity. The second wax is not higher than 1.5 in ratio of weight average molecular weight (Mw) to number average molecular weight (Mn), lower than 10 mPa·s in melt viscosity at 140° C. and higher than 85% and not higher than 95% in degree of crystallinity.

6 Claims, 2 Drawing Sheets

ELECTROSTATIC IMAGE DEVELOPING TONER AND IMAGE FORMING METHOD

BACKGROUND OF THE INVENTION

1. Field of the Invention

The present invention relates to electrostatic image developing toner for visualizing an electrostatic latent image formed in an electrophotographic method, an electrostatic printing method, an electrostatic recording method, or the like, and an image forming method using the electrostatic image developing toner.

2. Background Art

Of the printing or recording methods, for example, in the electrophotographic method, a photoconductor is charged and exposed so that an electrostatic latent image is formed on the photoconductor. Next, this electrostatic latent image is developed with fine-grained toner containing a coloring agent and so on, using resin as a binder. The obtained toner image is transferred and fixed onto recording paper to obtain a recorded image.

In such an electrostatic image recording process, the step of developing an electrostatic latent image with fine-grained toner, and the step of fixing a toner image onto recording paper are particularly important. In the related art, a magnetic brush developing method using a two-component developer composed of toner and magnetic carrier capable of performing high-speed and high-quality development is often used as a method for developing an image with toner. In addition, a heat roller fixing method which is high in thermal efficiency and capable of fixing toner at a high speed is often used as a method for fixing the toner.

On the other hand, recently, with the development of an information apparatus, laser beam printers have made an advance. In such a laser beam printer, a laser beam is used for exposing a photoconductor so as to reproduce every dot for a recorded image by a modulating signal based on instructions from a computer. Particularly, in a recent laser beam printer, the diameter of a laser beam is narrowed down to increase the dot density to 600–1,200 dpi (dots/inch) because the laser beam printer is requested to produce a higher quality image. With the increase of the dot density, the particle sizes of toner and carrier become smaller to develop a fine electrostatic latent image. Thus, application of fine-grained toner whose volume average particle size is not larger than 10 $\mu$m, and fine-grained carrier whose weight average particle size is not larger than 100 $\mu$m is advancing.

On the other hand, heat roller fixing as described above is often used for the fixing. However, development of toner which can be fixed with reduced power consumption of a fixing heater and a driving motor, and with lower temperature and lower pressure of a heat roller has been desired from the following points of view. That is, (1) To restrain the printer from being deteriorated due to overheating, and to prevent parts in the printer from being thermally deteriorated;
(2) To shorten warm-up time from the time when a fixing unit is actuated to the time when fixing becomes possible;
(3) To prevent a failure in fixing due to heat absorption into recording paper, so as to make it possible to keep image quality while feeding the paper continuously;
(4) To prevent the recording paper from being curled and fired due to overheating; and
(5) To reduce a load on the heat roller, and to simplify and miniaturize the structure of the fixing unit.

In this manner, development of high-performance toner which is of fine particles and which can be fixed at low temperature and with low pressure has been desired. On the other hand, when the toner is formed into fine particles not larger than 10 $\mu$m as described above, there arise problems as follows. That is, fine-grained toner used in the developing step indeed brings about high image quantity, but easily causes toner adhesion (fogging) to a non-image area, and toner flying thereon. Accordingly, the handling properties in toner shipping or the like are also easily degraded due to the lowering of fluidity.

Further, due to the strength of adhesion and the weakness of crashworthiness of the fine-grained toner, carrier pollution (carrier spent) with the toner is easily produced so that the life of developer is easily reduced. In addition, in order to obtain the same fixing strength for the fixing, more energy is required than in the case where toner larger in particle size is used. Further, the yield in the steps of graining and classifying in manufacturing the toner is reduced so that the cost of the toner increases.

Fine-grained toner brings about such a large number of problems. It is usually difficult to put toner smaller than 5 $\mu$m in average particle size into practical use. Therefore, toner classified to have an average particle size in a range of from 5 $\mu$m to 10 $\mu$m is used with the fluidity of the toner being enhanced by the improvement of external additives to the toner and the recipe for the external additives. On the other hand, the weight average particle size of the carrier is set to be not larger than 100 $\mu$m with the reduction in particle size of the toner. Thus, the specific surface area of the carrier is increased to improve the frictional electrostatic property with the toner. However, when the carrier is smaller than 30 $\mu$m, the magnetic force of the carrier is reduced to easily adhere onto an electrostatic image holding member due to electrostatic attraction force. Therefore, carrier classified to have an average particle size in a range of from 30 $\mu$m to 100 $\mu$m is used, and the surface of the carrier is coated with resin in accordance with necessity.

As a result of these improvements in the particle size distribution and in the fluidity and the electrostatic property, fine-grained toner and developer have been put into practical use in copying machines, printers, etc. However, when printing is performed with an actual apparatus, particularly when printing at a high speed not lower than 10 pages per minute is repeated, the fine-grained toner has its own peculiar problems as described above. Thus, the life of developer is reduced easily due to carrier spent by the toner, and the life of a photoconductor is reduced easily because the photoconductor is filmed with the toner.

In addition, it is difficult to obtain fixing strength of an image. Particularly in the fixing step, it is necessary to increase the temperature and pressure of a heat roller. Thus, there has been a problem that it is difficult to make a fixing unit highly reliable, simple, small in size and low in cost.

In order to improve the fixing performance of toner, it has been known to add wax to fixing resin. For example, such techniques are disclosed in Japanese Patent Laid-Open No. 3304/1977, No. 3305/1977 and No. 52574/1982.

Waxes are used to prevent toner from adhering to a heat roller at a low temperature or at a high temperature, that is, to prevent a so-called offset phenomenon, so as to improve the toner fixability at a low temperature. Recently, low-melting waxes attract attention from the point of view of low-temperature fixation.

For example, Japanese Patent Laid-Open No. 313413/1993 discloses that ethylene- or propylene-$\alpha$-olefin copolymer whose viscosity is not higher than 10,000 poises at 140° C. is added to vinyl-based copolymer having a particular molecular weight distribution in order to improve the low-temperature fixability, the offset resistance and the non-aggregability of toner.

In addition, for the similar purpose, Japanese Patent Laid-Open No. 287413/1995 discloses that paraffin wax showing a peak (melting point) at 75–85° C. in the amount of heat absorption measured by a differential scanning calorimeter (DSC) is added; Japanese Patent Laid-Open No. 314181/1996, No. 179335/1997 and No. 319139/1997 disclose that natural-gas-based Fischer-Tropsch wax whose melting point measured by a DSC is 85–100° C. is added; Japanese Patent Laid-Open No. 324513/1994 discloses that polyethylene wax whose melting point measured by a DSC is 85–110° C. is added; Japanese Patent Laid-Open No. 36218/1995 discloses that polyethylene-based wax in which any component having a melting point at 50° C. or lower has been eliminated in a distillation method and whose melting point measured by a DSC is 70–120° C. is added; and Japanese Patent Laid-Open No. 114942/1996 discloses that polyethylene wax whose weight average molecular weight (Mw) is lower than 1,000 is added.

On the other hand, when low-melting wax is added to toner, the toner deteriorates in heat resistance, durability, storage stability, and fluidity. In order to improve those properties, Japanese Patent Laid-Open No. 123994/1994 discloses that wax not higher than 1.5 in ratio (Mw/Mn) of weight average molecular weight to number average molecular weight is used; Japanese Patent Laid-Open No. 209909/1995 discloses that ethylene-based olefin copolymer wax whose melt viscosity is 0.5–10 mPa·s at 140° C. and whose penetration degree is not higher than 3.0 dmm is used; and Japanese Patent Laid-Open No. 287418/1995 discloses that Fischer-Tropsch wax whose average molecular weight is not lower than 1,000 is used.

The fixing performance of toner can be indeed improved using such related-art techniques. When low-melting wax is used, particularly when toner is of fine particles, it is however difficult to improve the fixing performance while keeping the heat resistance, the durability, the storage stability and the fluidity of the toner. Thus, it is not possible to provide toner capable of being put into practical use, and an image forming method using the toner.

SUMMARY OF THE INVENTION

An object of the invention is to provide toner in which the heat resistance, the durability, the storage stability and the fluidity of the toner are so excellent that the life of developer is hardly reduced due to carrier spent by the toner, and the life of a photoconductor is hardly reduced due to filming of the photoconductor with the toner; in which energy required for fixing is so small that temperature and pressure of a heat roller can be reduced when a heat roller fixing method is adopted; and in which an offset phenomenon is hardly produced. Another object of the invention is to provide a stable image forming method using such toner.

The object is achieved by electrostatic image developing toner including at least fixing resin and wax, wherein the wax is hydrocarbon-based wax, containing, as its constitutional components, first wax and second wax; the first wax is higher than 1.5 in ratio of weight average molecular weight (Mw) to number average molecular weight (Mn), lower than 10 mPa·s in melt viscosity at 140° C. and higher than 75% and not higher than 85% in degree of crystallinity; and the second wax is not higher than 1.5 in ratio of weight average molecular weight (Mw) to number average molecular weight (Mn), lower than 10 mPa·s in melt viscosity at 140° C. and higher than 85% and not higher than 95% in degree of crystallinity.

DETAILED DESCRIPTION OF THE PREFERRED EMBODIMENTS

Figure 1:
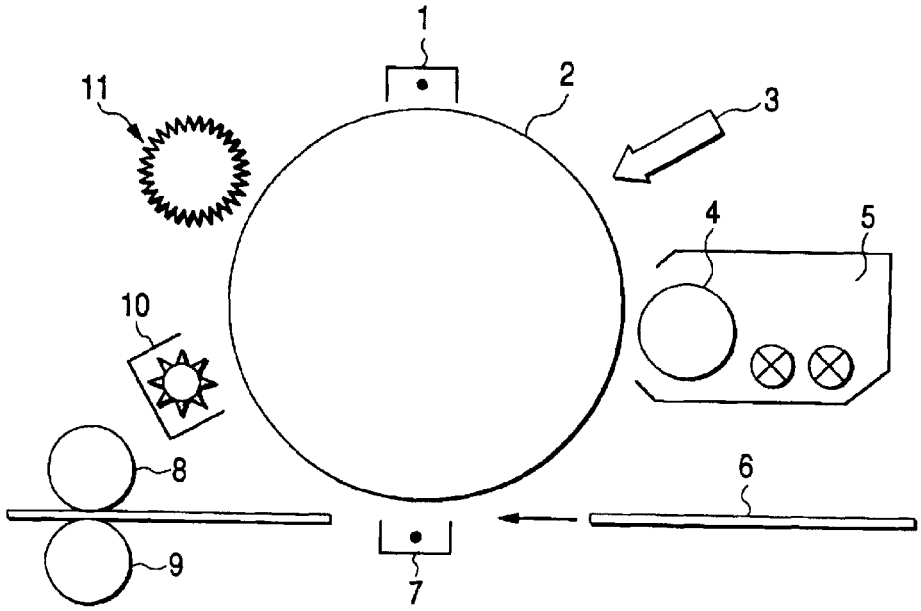
FIG. 1 is a view showing an embodiment of an electrostatic image recording process according to the invention.

The invention will be described below in detail. As for toner fixing resin, vinyl-based copolymer, particularly styrene-(meth)acrylic-based resin is generally used for the heat roller fixation. Recently, polyester-based resin is also used. However, polyester-based resin typically has polar groups (hydroxyl group and carboxyl group) having high water absorption properties. Thus, the toner using polyester-based resin is apt to absorb moisture and hence apt to change in electrostatic property. Therefore, styrene-(meth)acrylic-based resin still prevails as toner resin. Waxes are added to the fixing resin so as to improve the fixing performance of the toner.

Waxes have been generally used in toner as anti-offset agents traditionally. On the other hand, there is however a problem that the toner deteriorates in heat resistance, durability, storage stability, and fluidity, so that fusion is apt to occur. There are a large number of kinds of waxes, which are chosen in accordance with their own functions. From the point of view to prevent toner from being offset, hydrocarbon-based wax which is nonpolar and nonadhesive to a heat roll is the most suitable.

Hydrocarbon-based wax is an aggregate of polyolefin molecules having a molecular weight distribution, and the properties thereof depend largely on the molecular weight distribution. Generally, hydrocarbon-based wax has effect not only on the prevention of high temperature offset but also on the prevention of lower temperature offset and the improvement of low temperature fixing performance when low-molecular weight components are increased.

However, when the low-molecular weight components are increased to improve the fixing performance, the heat resistance, the durability or the storage stability of the toner deteriorates, and fusion to developer carrier or a photoconductor becomes easy to occur. It is therefore attempted to cut low-molecular weight components thoroughly from existing hydrocarbon-based wax so as to make its molecular weight distribution sharp. That is, the molecular weight distribution of the wax is made so sharp that the ratio (Mw/Mn) of weight average molecular weight to number average molecular weight is not higher than 1.5, preferably not higher than 1.45 in the molecular weight distribution measurable by gel permeation chromatography (GPC) (Japanese Patent Laid-Open No. 123994/1994).

However, according to the investigation of the present inventors, it was proved that when the molecular weight distribution of the hydrocarbon-based wax was made sharp as described above, the heat resistance, the durability and the storage stability of the toner were indeed improved, but the fixing performance thereof became insufficient, particularly the fixing performance in fine-grained toner deteriorated when high-speed printing at the rate of 10 pages or more per minute was repeated.

Therefore, the inventors investigated various hydrocarbon-based waxes, so that waxes containing a proper amount of low molecular weight components and having a ratio of weight average molecular weight (Mw) to number average molecular weight (Mn) higher than 1.5 were applied to toner, and properties of the waxes were evaluated. As a result, it was proved that the fixing performance of toner could be improved greatly when the melt viscosity at 140° C. was lower than 10 mPa·s, the degree of crystallinity was not higher than 85%, and the melting point (Tmp) of the wax defined by the maximum value of endothermic peaks on a heat absorption curve during temperature rise in DSC curves measured by a differential scanning calorimeter was lower than 110° C. [first wax]

In the invention, the molecular weight distribution of the wax is expanded to exceed 1.5. However, in order to obtain a sufficient fixing property and a sufficient anti-offset property, it is necessary to control the molecular weight distribution so that the melt viscosity of the wax at 140° C. is lower than 10 mPa·s and the degree of crystallinity becomes low to be not higher than 85%. When the melt viscosity or the degree of crystallinity of the wax becomes large to exceed such a range, it is not possible to obtain a sufficient fixing property or a sufficient anti-offset property in high-speed fixation using fine-grained toner.

When a proper amount of wax according to the invention is added to fixing resin, the fixing performance of the toner can be improved greatly. However, the wax according to the invention wide in molecular weight distribution and low in viscosity is added to the toner, the heat resistance, the durability and the storage stability of the toner deteriorate easily. In order to prevent these properties of the toner from being deteriorated, the molecular weight distribution of the wax is adjusted so that the melt viscosity of the wax at 140° C. exceeds 4 mPa·s and/or the degree of crystallinity exceeds 75%. Such wax can be obtained industrially by refining low polymer of polyethylene obtained in a medium-pressure or low-pressure polyethylene polymerization process using a Ziegler catalyst or a metallocene catalyst. That is, oil contents, oligomers, etc., are eliminated from the low polymer of polyethylene in a vacuum distillation method or the like. In accordance with necessity, low molecular weight components are eliminated appropriately from residual distillate obtained from the low polymer of polyethylene, at high temperature and at highly reduced pressure. Specific examples of such waxes include NEOWAX L (trade name), NEOWAX AL (trade name), NEOWAX LS (trade name), NEOWAX CL (trade name), and NEOWAX ACL (trade name) all made by Yasuhara Chemical Co., Ltd.

In the invention, the heat resistance, the durability and the storage stability of the toner are improved by adjusting the molecular weight distribution of the wax. When the improvement is insufficient, or when it is intended to improve the fluidity, a part of the wax can be replaced by other waxes. As a result of various researches on most suitable waxes on that occasion, it was proved that it was preferable to use hydrocarbon-based wax not higher than 1.5 in the ratio of weight average molecular weight (Mw) to number average molecular weight (Mn), lower than 10 mPa·s in melt viscosity at 140° C. and higher than 85% and not higher than 95% in degree of crystallinity. In addition, it was proved that the heat resistance, the durability, the storage stability and the fluidity of the toner could be improved without spoiling the fixing performance of the toner when the melting point (Tmp) of the wax mixture defined by a maximum value of endothermic peaks on a heat absorption curve during temperature rise in DSC curves measured by a differential scanning calorimeter was lower than 110° C. [second wax]

Here, the melt viscosity of the hydrocarbon-based wax partially replaced by other waxes is set to be lower than 10 mPa·s. However, when the melt viscosity is too low, the heat resistance, the durability, the storage stability and the fluidity of the toner deteriorate. Accordingly, it is preferable that the melt viscosity is higher than 0.5 mPa·s. Further, the degree of crystallinity is set to be higher than 85% and not higher than 95%. When the degree of crystallinity is below this set range, the heat resistance, the durability, the storage stability and the fluidity of the toner deteriorate. On the contrary, when the degree of crystallinity is beyond the set range, the fixing performance of the toner deteriorates.

In the invention, low-viscosity hydrocarbon-based wax which is lower than 10 mPa·s in melt viscosity at 140° C. is used. When a large amount of such low-viscosity hydrocarbon-based wax is added to toner so as to improve the fixing strength thereof, the heat resistance, the durability, the storage stability and the fluidity of the toner are apt to deteriorate unless the dispersibility of the wax into the toner is improved. As a method for improving the dispersibility of the wax into the toner, there is a method for increasing the energy with which the toner is hot-melted and kneaded, so as to disperse the wax into the fixing resin finely. In this method, the dispersibility of the wax is indeed improved, but there is an adverse effect that the fixing resin is damaged mechanically so that the fixing property or the high-temperature anti-offset property deteriorates. Therefore, as another method for improving the dispersibility of the wax, there is a coexistent polymerization method, as disclosed in Japanese Patent Laid-Open No. 313413/1993, No. 281748/1997 or No. 304966/1997, in which wax is made coexistent in all or a part of a process for synthesizing fixing resin. According to the invention, as a result of investigation in the coexistent polymerization method, the wax could be dispersed into the fixing resin uniformly without deterioration of the resin.

In addition, when the resin obtained in this coexistent polymerization method was applied to toner, it was proved that it was possible to provide a stable electrostatic toner image forming method in which the heat resistance, the durability, the storage stability and the fluidity of the toner did not deteriorate even when a comparatively large amount of wax was added to the toner, so that the life of developer was hardly reduced due to carrier spent by the toner, and the life of a photoconductor was hardly reduced due to filming of the photoconductor with the toner.

In addition, as for the melt physical property of the toner obtained by use of fixing resin and the inventive wax, the performance of the inventive wax can exhibit its maximum performance when the melting start temperature (Tfb) of the toner has a relationship of Tmp<Tfb<110° C. to a melting point (Tmp) corresponding to a maximum value of endothermic peaks attributed to the wax on a heat absorption curve during temperature rise in DSC curves of the toner measured by a differential scanning calorimeter, and the glass transition point (Tg) of the toner is beyond 50° C. Thus, it is possible to obtain toner having excellent fixing performance, excellent heat resistance, excellent durability, excellent storage stability and excellent fluidity.

According to the invention, the melting point (Tmp) of the wax is set to be lower than 110° C. in order to improve the fixing performance. Further, the melting point (Tmp) of the wax is set to be lower than the melting start temperature (Tfb) of the toner so that the wax is allowed to melt before the toner starts melting in the fixing step. Thus, the mold release effect of the toner to the fixing roll can be enhanced to prevent offset, while the fixing strength can be enhanced. In addition, the glass transition point (Tg) of the toner is set to be beyond 50° C. so that the storage stability of the toner is secured. As a result, while the fixing performance of the toner is excellent, the life of developer is hardly reduced due to carrier spent by the toner, and the life of a photoconductor is hardly reduced due to filming of the photoconductor with the toner. It is therefore possible to provide a stable electrostatic toner image forming method.

The molecular weight distribution of the hydrocarbon-based wax in the invention is measured by gel permeation chromatography (GPC) at high temperature under the following conditions.

(GPC Measuring Conditions)

Apparatus: ALC/GPC 150-C (made by Waters Corp.)

Isolation Column: GMH-HT 60 cm×1 and GMH-HTL 60 cm×1 (made by TOSOH Corp.)

Column Temperature: 135° C.

Mobile Phase: o-dichlorobenzene

Detector: differential refracting gauge

Flow Rate: 1.0 ml/min

Specimen Density: 0.15 wt %

Injection Rate: 400 μl

Measurement is made under the above conditions. Molecular weight of a specimen is calculated and converted to a polyethylene basis by use of the Mark-Houwink-Sakurada equation or a conversion equation derived from a viscosity equation, using a molecular weight calibration curve obtained from a monodisperse polystyrene standard specimen.

In addition, the molecular weight distribution of the fixing resin is measured by GPC under the following conditions.

(GPC Measuring Conditions)

Apparatus: HLC-8120GPC (made by TOSOH Corp.)

Isolation Column: TSKgel Super HM-H/H4000/H3000/H2000, 6.0 mmI.D.×150 mm

Column Temperature: 40° C.

Mobile Phase: tetrahydrofuran (THF)

Detector: differential refracting gauge

Flow Rate: 0.6 ml/min

Specimen Density: 3 g/l THF

Injection Rate: 20 μl

Measurement is made under the above conditions. Molecular weight of a specimen is calculated by use of a molecular weight calibration curve obtained from a monodisperse polystyrene standard specimen. Thus, molecular weight, molecular weight distribution and so on are obtained in the resin as a whole.

In the invention, a value of the melt viscosity of the wax at 140° C. is measured by use of a Brookfield Method type viscometer. In addition, the degree of crystallinity of the wax is measured in an X-ray diffraction method under the following conditions.

X-ray: Cu-$K_\alpha$ ray (monochromatized by a graphite monochrometer)

Wavelength $\lambda$=1.5406 angstroms

Output: 40 kV, 40 mA

Optics: reflection method, slit DS, SS=1°, RS=0.3 mm

Measuring Range: 2θ=10°–35°

Step Interval: 0.02°

Scanning Rate: 2θ/θ continuous scan 1.00°/min

Measurement is made under the above conditions. The X-ray diffraction profile of a specimen is separated into three crystal peaks and an amorphous scatter. The degree of crystallinity is calculated from those areas in the following expression.

$$\text{Degree of Crystallinity } (\%) = Ic/(Ic+Ia)\times 100$$

Ic: sum of areas of the crystal peaks

Ia: the sum of areas of the crystal peaks+the area of amorphous scatter

On the other hand, the exchange of heat in the wax or the toner is measured in DSC measurement, and the behavior thereof is observed. It is therefore preferable to make measurement with an ultra sensitive heat flux type differential scanning calorimeter from the point of view of a measuring principle. For example, a DSC model 2910 made by TA Instruments Ltd. can be used. Measurement is made under the following conditions. That is, about 5 mg of the wax or the toner is weighed and mounted on the DSC. Nitrogen gas is blown at the rate of 50 ml per minute, and the temperature is increased from 20° C. to 160° C. at the rate of 10° C. per minute. Next, the temperature is decreased from 160° C. to 20° C. at the rate of 10° C. per minute. Thus, the previous thermo history is removed. After that, the temperature is increased at the rate of 10° C. per minute again. Thus, the melting point (Tmp) of the wax or the toner corresponding to a maximum value of endothermic peaks is obtained from the maximum peak of a DSC heat absorption curve at that time shown in FIG. 2.

Figure 2:
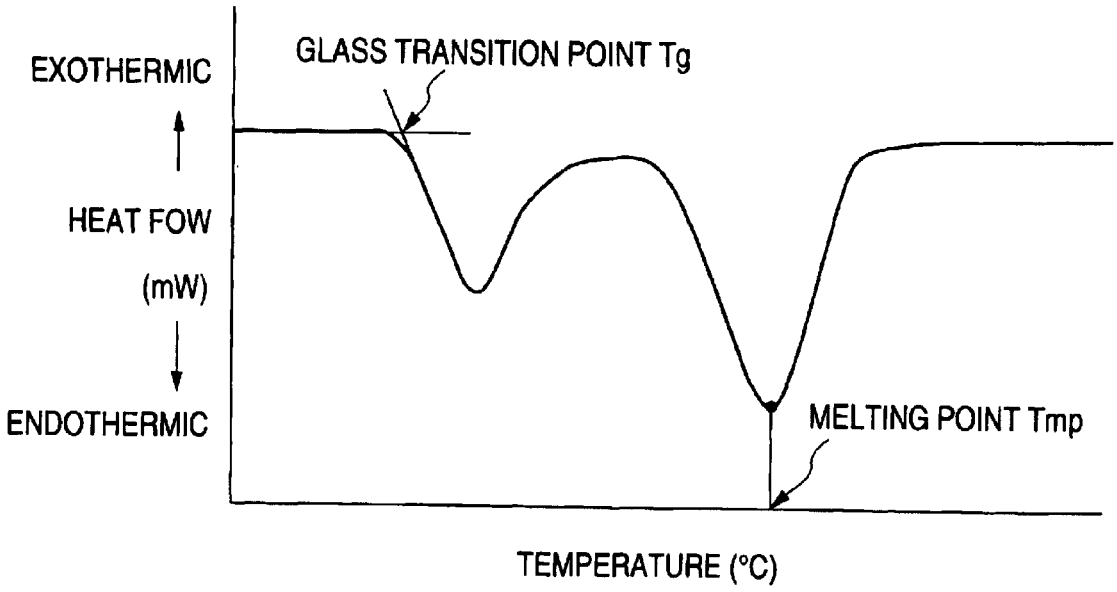
FIG. 2 is an explanatory view showing an example of measuring a melting point and a glass transition point based on a DSC heat absorption curve.

On the other hand, in a heat absorption curve of the toner measured in the DSC measurement as shown in FIG. 2., the glass transition point (Tg) of the toner is obtained by a shoulder Tg of a part of the heat absorption curve attributed to the fixing resin.

Figure 3:
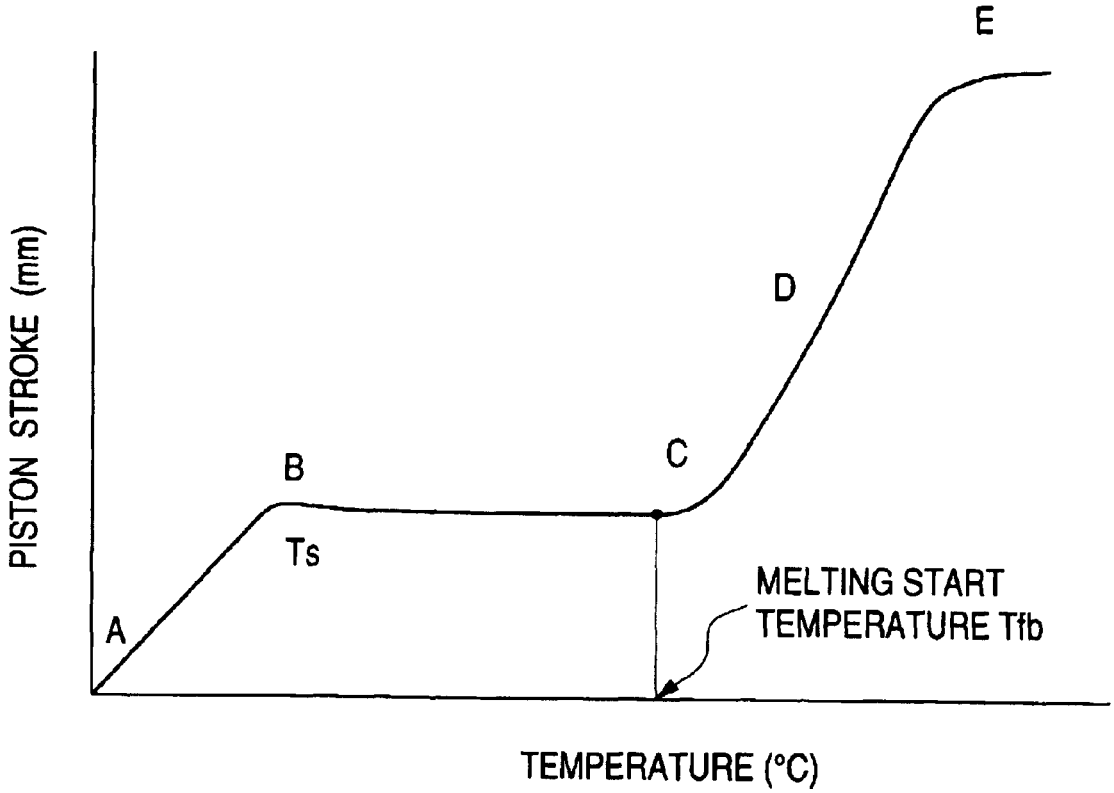
FIG. 3 is an explanatory view showing an example of measuring a melting start temperature using a constant-load extrusion type capillary rheometer.

In the invention, the melting start temperature (Tfb) of the toner is measured on the basis of a flow process of a piston stroke shown in FIG. 3, in a temperature rising method and by use of a constant-load extrusion type capillary rheometer (flow tester CFT-500C model made by Shimadzu Corp.). On this occasion, as the measuring conditions of the flow tester, the load is set at 20 kgf/cm$^2$, the die diameter is set at 1 mm, the die length is set at 10 mm, and the temperature rising rate is set at 6° C./min.

In the toner according to the invention, it is preferable that the hydrocarbon-based wax is added to the fixing resin at the ratio of 0.5–20 wt % as the total weight of the wax. When the wax is lower than 0.5 wt %, the effect to improve the fixing performance of the toner is insufficient. On the contrary, when the wax is higher than 20 wt %, the durability of the toner deteriorates, and high-temperature offset occurs easily. In addition, other waxes may be used together, but it is necessary to use the other waxes carefully not to spoil the performance of the hydrocarbon-based wax according to the invention.

The vinyl-based copolymer used in the fixing resin according to the invention may include, as its constitutional units, styrene-based monomers and/or (meth)acrylic-ester-based monomers, and may include other vinyl-based monomers.

Specific examples of the styrene-based monomers in the invention may include o-methyl styrene, m-methyl styrene, p-methyl styrene, α-methyl styrene, p-ethyl styrene, 2,4-dimethyl styrene, p-n-butyl styrene, p-ter-butyl styrene, p-n-hexyl styrene, p-n-octyl styrene, p-n-dodecyl styrene, p-methoxystyrene, p-phenylstyrene, p-chlorostyrene, and 3,4-dichlorostyrene, as well as styrene.

Specific examples of the acrylic-ester-based or methacrylic-ester-based monomers may include acrylic or methacrylic alkyl esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate, 2-ethylhexyl methacrylate, and stearyl methacrylate; and may further include 2-chloroethyl acrylate, phenyl acrylate, α-chloromethyl acrylate, phenyl methacrylate, dimethylaminoethyl methacrylate, diethylaminoethyl methacrylate, 2-hydroxyethyl methacrylate, glycidyl methacrylate, bisglycidyl methacrylate, polyethylene glycol dimethacrylate, and methacryloxy ethyl phosphate. Particularly, ethyl acrylate, propyl acrylate, butyl acrylate, methyl methacrylate, ethyl methacrylate, propyl methacrylate, and butyl methacrylate are preferably used.

Examples of the other vinyl-based monomers in the invention may include acrylic acids such as acrylic acid, methacrylic acid, α-ethyl acrylic acid and crotonic acid, and/or their α- or β-alkyl derivatives; unsaturated dicarboxylic acids such as fumaric acid, maleic acid, citraconic acid and itaconic acid, and their mono-ester derivatives or diester derivatives; succinic monoacryloyl oxyethyl ester, succinic monomethacryloyl oxyethyl ester, acrylonitrile, methacrylonitrile, and acrylamide.

As the fixing resin in the invention, these vinyl-based copolymers may be used as they are. However, coexistent polymerization, in which these vinyl-based copolymers are used and hydrocarbon-based wax according to the invention is made coexistent, may be performed in the whole or apart of the process for synthesizing the fixing resin. Then, at least vinyl-based copolymer in which the wax has been dispersed uniformly can be included as a constitutional unit of the fixing resin. Incidentally, the vinyl-based copolymer may be partially cross-linked by a cross-linker chiefly composed of monomer having at least two polymerizable double bonds, such as divinyl benzene, divinyl naphthalene, ethylene glycol dimethacrylate, 1,3-butanedioldimethacrylate, divinyl aniline, divinyl ether, divinyl sulfide, or divinyl sulfone.

When a charge control agent is compounded (internally added) or mixed (externally added) to toner particles in the toner according to the invention, the charge quantity of the toner can be controlled to a desired value.

Examples of positive charge control agents for the toner include nigrosine and its modified products using fatty acid and the like; onium salts of quaternary-ammonium-salts such as tributylbenzylammonium-1-hydroxy-4-naphthosulfonic acid or tetrabutylammonium tetrafluoroborate, phosphonium salts analogous to these, and lake pigments of these; triphenylmethane dyes, and lake pigments of this; metal salts of higher fatty acids; diorgano tin oxides such as dibutyl tin oxide, dioctyl tin oxide, and dicyclohexyl tin oxide; and diorgano tin borates such as dibutyl tin borate, dioctyl tin borate, and dicyclohexyl tin borate. One or more kinds of such positive charge control agents maybe used alone or in combination. Of these examples, charge control agents of nigrosine, quaternary-ammonium-salts, and triphenylmethane-based dyes are preferably used.

Organic metal complexes or chelate compounds are effective as negative charge control agents for the toner. Examples of the organic metal complexes include monoazo metal complexes, acetylacetone metal complexes, and aromatic hydroxyl carbonic acid-based or aromatic dicarbonic acid-based metal complexes. As other examples, there are aromatic hydroxylcarbonic acids, aromatic mono- and polycarbonic acids, and their metal salts, anhydrides, esters, and phenolic derivatives such as bisphenol.

When such a charge control agent is internally added to the toner, it is preferable to add the charge control agent at the ratio of 0.1–10 wt % to the fixing resin.

In the toner according to the invention, it is preferable that silica impalpable powder is externally added to improve the developing property, the fluidity, the electrostatic stability and the durability of the toner.

Preferably, the silica impalpable powder used in the invention has a specific surface area of not smaller than 30 $m^2/g$ measured by nitrogen adsorption following the BET method, and it is externally added at the ratio of 0.01–5 wt % to the toner. In addition, the silica impalpable powder is used while it is made hydrophobic or controlled electrostatically by various treatments such as organic silicon compounds or other treatments in accordance with necessity.

Further, lubricant powder such as fluororesin powder, zinc stearate powder, or polyvinylidene fluoride powder is preferably used as another additive to the toner. Of them, polyvinylidene fluoride powder is particularly preferred. Powder abrasive such as cerium oxide powder, silicon carbide powder or strontium titanate powder is also preferably used. Of them, strontium titanate powder is particularly preferred. A fluidity enhancer such as titanium oxide powder or aluminum oxide powder is also preferably used. Of them, hydrophobic one is particularly preferred. An anti-aggregation agent, an electric conductivity enhancer such as carbon black powder, zinc oxide powder, antimony oxide powder or tin oxide powder, and a developing property improver composed of antipolar white fine particles and black fine particles may be used by low doses.

When the toner according to the invention is used as a two-component developer, the toner is mixed with carrier. In this case, the mixing ratio of the toner to the carrier is preferably 2–10 wt % in toner density.

As the carrier obtained and used in the invention, known ones are available. Examples of such carriers include iron powder, ferrite, magnetite, glass beads, and these carriers coated with fluorine-based resin, vinyl-based resin or silicone-based resin.

Although the toner according to the invention is typically used as two-component developer composed of toner and carrier, the toner may contain a magnetic material so as to be used as magnetic toner in the form of one-component toner. In this case, the magnetic material may also play a role of a coloring agent. In the invention, examples of such magnetic materials contained in the magnetic toner may include iron oxides such as magnetite, hematite and ferrite; metals such as iron, cobalt and nickel; alloys between these metals and metals such as aluminum, cobalt, copper, lead, magnesium, tin, zinc, antimony, calcium, manganese, selenium, titanium, tungsten and vanadium; and mixtures of these magnetic materials.

The average particle size of these magnetic materials is set to be not larger than 2 μm, preferably about 0.1–0.5 μm. The quantity of the magnetic materials to be contained in the toner is preferably 30–70 wt % relative to the fixing resin.

Any suitable one of known pigments or dyes can be mentioned as the coloring agent that can be obtained and used in the toner according to the invention. Examples of the pigments used as the coloring agent in the toner include carbon black, aniline black, acetylene black, naphthol yellow, Hansa yellow, rhodamine lake, alizarin lake, colcothar, phthalocyanine blue, and indanthrene blue. These pigments are used by adequate doses necessary and sufficient to keep the optical density of a fixed image, and preferably added at the ratio of 0.2–15 wt % to the resin.

Further, dyes are used for the similar purpose. Examples of such dyes include azo-based dyes, anthraquinone-based dyes, xanthene-based dyes, and methine-based dyes. These dyes are added at the ratio of 0.2–15 wt % to the resin.

To produce the electrostatic image developing toner according to the invention, fixing resin, hydrocarbon-based wax, and/or fixing resin containing hydrocarbon-based wax according to the invention in which the wax has been dispersed uniformly by coexistent polymerization, a charge control agent, pigment or dye as a coloring agent, magnetic powder, and further other waxes or additives in accordance with necessity, are mixed sufficiently by a mixer such as a Henschel mixer or a super mixer. Such raw materials are then melted and kneaded by a hot-melt kneader such as a heating roll, a kneader or an extruder till they are mixed sufficiently. After that, the mixture is cooled and solidified. The solid mixture is finely pulverized and classified to obtain toner whose average particle size is 5–10 $\mu$m. Further, desired additives are mixed to the toner by a mixer such as a Henschel mixer in accordance with necessity so as to adhere to the surface of the toner. Thus, it is possible to obtain toner to which the additives have been externally added.

According to inventive toner, an electrostatic latent image formed on an electrostatic image holding member is made visible by use of two-component developer composed of the toner and carrier, and the visible toner image obtained thus is transferred onto a recording medium. Further, a residual toner image on the electrostatic image holding member is cleaned up while the toner image transferred on the recording medium is fixed to obtain a recorded image. In such an electrostatic image recording process, it is possible to obtain a stable electrostatic toner image forming method in which particularly good fixing performance is exhibited, the heat resistance, the durability, the storage stability and the fluidity of the toner are so excellent that the life of the developer is hardly reduced due to carrier spent by the toner, and the life of a photoconductor is hardly reduced due to filming of the photoconductor with the toner.

Description will be made below on examples of the invention. However, the invention is not limited to the examples.

EXAMPLE 1

A toner raw material composed of 86 wt % of styrene-acryl-based copolymer resin which was composed of 90 wt % of styrene and 10 wt % of n-butyl acrylate and whose weight average molecular weight was about 300,000, 1 wt % of chromium containing metal dye (made by Orient Chemical Industries Ltd., trade name: BONTRON S-34), 8 wt % of carbon black (made by Mitsubishi Chemical Corp., trade name: MA-100), 4 wt % of hydrocarbon-based wax A (made by Yasuhara Chemical Co., Ltd., trade name: NEOWAX AL) and 1 wt % of hydrocarbon-based wax B (made by Toyo-Petrolite Co., Ltd., trade name: PW655) was premixed by a super mixer, and hot-melt-kneaded by a biaxial kneader. Then, the thus obtained mixture was pulverized by a jet mill, and then classified by a dry air flow classifier so as to obtain particles whose average particle size was about 9 $\mu$m. Further, 0.8 wt % of hydrophobic silica (made by Nippon Aerosil Co., Ltd., trade name: AEROSIL R972) was added to the particles, and stirred by a Henschel mixer so as to adhere to the surfaces of the particles. Thus, toner in this example was obtained.

The hydrocarbon-based wax A was a refined material of medium/low pressure polyethylene low polymer, which was 1.71 in ratio (Mw/Mn) of weight average molecular weight to number average molecular weight and 8.5 mPa·s in melt viscosity at 140° C., which had a melting point at 83° C. in DSC endothermic peak and whose degree of crystallinity was 83% based on an X-ray diffraction method. On the other hand, the hydrocarbon-based wax B was a perfectly saturated ethylene homopolymer, which was 1.20 in ratio (Mw/Mn) of weight average molecular weight to number average molecular weight and 6.0 mPa·s in melt viscosity at 140° C., which had a melting point at 93° C. in DSC endothermic peak and whose degree of crystallinity was 93% based on the X-ray diffraction method.

The melting start temperature (Tfb) of the toner was 103° C. The melting point (Tmp) of the wax component of the toner corresponding to a maximum value of a heat absorption curve in DSC was 85° C. The glass transition point of the toner was 52° C.

The toner was applied to an electrophotographic laser beam printer using an OPC as a photoconductor. Thus, images were formed under the conditions of OPC charged potential of −650 V, residual potential of −50 V, developing bias potential of −400 V, developing-site contrast potential of 350 V, and printing speed of 60 sheets per minute (printing process speed of 26.7 cm/sec). Developer with toner density of 2.5 wt % was prepared using, as carrier, magnetite carrier (electric resistance of $4.1\times10^8$ Ω·cm) having a weight average particle size of 100 $\mu$m and coated with conductive agent containing silicone-based resin. A developing unit was set as follows. That is, a developing gap (distance between a photoconductor and a developing roll sleeve) was set at 0.8 mm. The photoconductor and the developing roll were moved in the same direction. The peripheral speed ratio between the both (developing roll to photoconductor) was set at 3. Thus, images were formed by reversal development in a magnetic brush developing method.

As for a fixing unit, a core made of aluminum was thinly coated (in a thickness of 40 $\mu$m) with a tube of fluororesin (perfluoroethylene-perfluoroalkylvinylether copolymer: PFA), and a heater lamp was installed in a center portion so as to form a heat roll. In addition, a silicone rubber layer (7 mm thick) having a rubber hardness of about 30 degrees was provided on a core made of aluminum, and the outermost layer thereof was coated with a PFA tube so as to form a backup roll. The fixing conditions were set as follows. That is, the process speed was set at 26.7 cm/sec. The outer diameters of the heat roll and the backup roll were set at 60 mmϕ. The pressing load was set at 50 kgf. The width of a contact area (nip) between the heat roll and the backup roll was set at about 7 mm. The controlled temperature of the heat roll was set at 175° C. Incidentally, a cleaner of a type which could wind Nomex paper impregnated with silicone oil was installed in the heat roll.

The storage stability of the toner was evaluated as follows. That is, the toner was put onto a petri dish made of metal, and left at 50° C. for 24 hours in a desiccator whose humidity was controlled to be 65% RH by a humidity control agent. Thus, the degree of aggregation of the toner was evaluated by eye observation. As a result, the storage stability of the toner was excellent without producing any remarkable aggregation. In addition, when the toner was applied to the laser beam printer so as to carry out continuous printing, excellent fixing performance could be obtained. Even if 300,000 pages were printed continuously repeatedly, the life of the developer was not reduced due to carrier spent by the toner, and the life of the photoconductor was not reduced because the photoconductor was filmed with the toner. Thus, stable images could be obtained.

EXAMPLE 2

Toner in this example was obtained in the same manner as that in Example 1, except that Fischer-Tropsch wax (made by Nippon Seiro Co., LTD., trade name: FT-100) synthesized out of natural gas was used as the hydrocarbon-based wax B. The wax was 1.17 in ratio (Mw/Mn) of weight average molecular weight to number average molecular weight and 7.8 mPa·s in melt viscosity at 140° C. The wax had a melting point at 94° C. in DSC endothermic peak. The degree of crystallinity of the wax was 90% based on the X-ray diffraction method. The melting start temperature (Tfb) of the toner was 102° C. The melting point (Tmp) of the wax component of the toner corresponding to a maximum value of a heat absorption curve in DSC was 86° C. The glass transition point of the toner was 52° C.

The toner was evaluated in the same manner as in Example 1. As a result, excellent result could be obtained similarly to that in Example 1.

EXAMPLE 3

Toner in this example was obtained in the same manner as that in Example 1, except that Fischer-Tropsch wax (made by Schumann Sasol, trade name: SPRAY30) synthesized out of coal was used as the hydrocarbon-based wax B. The wax was 1.36 in ratio (Mw/Mn) of weight average molecular weight to number average molecular weight and 6.9 mPa·s in melt viscosity at 140° C. The wax had a melting point at 80° C. in DSC endothermic peak. The degree of crystallinity of the wax was 90% based on the X-ray diffraction method. The melting start temperature (Tfb) of the toner was 102° C. The melting point (Tmp) of the wax component of the toner corresponding to a maximum value of a heat absorption curve in DSC was 82° C. The glass transition point of the toner was 51° C.

The toner was evaluated in the same manner as in Example 1. As a result, excellent result could be obtained similarly to that in Example 1.

EXAMPLE 4

Toner in this example was obtained in the same manner as that in Example 1, except that synthetic paraffin wax (made by Nippon Seiro Co., Ltd., trade name: HNP11) was used as the hydrocarbon-based wax B. The wax was 1.06 in ratio (Mw/Mn) of weight average molecular weight to number average molecular weight and 2.6 mPa·s in melt viscosity at 140° C. The wax had a melting point at 70° C. in DSC endothermic peak. The degree of crystallinity of the wax was 92% based on the x-ray diffraction method. The melting start temperature (Tfb) of the toner was 101° C. The melting point (Tmp) of the wax component of the toner corresponding to a maximum value of a heat absorption curve in DSC was 81° C. The glass transition point of the toner was 52° C.

The toner was evaluated in the same manner as in Example 1. As a result, excellent result could be obtained similarly to that in Example 1.

EXAMPLE 5

Resin having a maximum value of about 400,000 in the molecular weight distribution was obtained by polymerization of 70 parts by weight of styrene, 10 parts by weight of methyl methacrylate and 20 parts by weight of n-butyl acrylate. A mixture of 200 g of this resin and 45 g of the hydrocarbon-based wax A (made by Yasuhara Chemical Co., Ltd., trade name: NEOWAX AL) used in Example 1 was put into a 3-liter separable flask and dissolved in 1 liter of xylene. After the gas phase was replaced by nitrogen gas, this system was heated to the boiling point (135–145° C.) of the xylene.

In the state where reflux of the xylene occurred, the solution was stirred while a mixture of 440 g of styrene, 65 g of n-butyl acrylate and 30 g of t-butylperoxy-2-ethylhexanoate dissolved as polymerization initiator was dropped for 2.5 hours. Thus, solution polymerization was performed so that low molecular weight polymeric components were polymerized in the presence of the high molecular weight polymer and the hydrocarbon-based wax A. After the dropping was terminated, the solution was further aged for 1 hour while being stirred at the temperature with which the xylene was boiling. After that, the temperature of the system was increased to 180° C. gradually while the xylene was removed in reduced pressure. Thus, resin having a low-molecular-weight-side peak of about 4,500 in its molecular weight distribution was obtained.

In this resin, the content of the hydrocarbon-based wax A was about 6 wt %. The wax was a refined material of medium/low pressure polyethylene low polymer. The wax was 1.71 in ratio (Mw/Mn) of weight average molecular weight to number average molecular weight and 8.5 mPa·s in melt viscosity at 140° C. The wax had a melting point at 83° C. in DSC endothermic peak. The degree of crystallinity of the wax was 83% based on an X-ray diffraction method.

Next, a toner raw material composed of 89 wt % of styrene-acryl-based copolymer resin containing the hydrocarbon-based wax A, 1 wt % of hydrocarbon-based wax B (made by Toyo-Petrolite Co., Ltd., trade name: PW655) which was used in Example 1, which was 1.20 in ratio (Mw/Mn) of weight average molecular weight to number average molecular weight and 6.0 mPa·s in melt viscosity at 140° C., which had a melting point at 93° C. in DSC endothermic peak and whose degree of crystallinity was 93% based on an X-ray diffraction method, 1 wt % of chromium containing metal dye (made by Orient Chemical Industries Ltd., trade name: BONTRON S-34) and 9 wt % of carbon black (made by Mitsubishi Chemical Corp., trade name: MA-100) was premixed by a super mixer, and hot-melt-kneaded by a biaxial kneader. Then, the thus obtained mixture was finely pulverized by a jet mill, and then classified by a dry air flow classifier so as to obtain toner particles whose average particle size was about 9 $\mu$m.

Further, 0.8 wt % of hydrophobic silica (made by Nippon Aerosil Co., Ltd., trade name: AEROSIL R972) was added to the particles, and stirred by a Henschel mixer so as to adhere to the surfaces of the particles. Thus, toner in this example was obtained. The melting start temperature (Tfb) of the toner was 100° C. The melting point (Tmp) of the wax component of the toner corresponding to a maximum value of a heat absorption curve in DSC was 82° C. The glass transition point of the toner was 51° C.

The toner was evaluated in the same manner as in Example 1. As a result, excellent result could be obtained similarly to that in Example 1.

What is claimed is:

1. Electrostatic image developing toner, comprising:

fixing resin; and wax;

wherein the wax is hydrocarbon-based wax;

the wax is containing, as its constitutional components, first wax and second wax;

the first wax is higher than 1.5 in ratio of weight average molecular weight (Mw) to number average molecular weight (Mn), lower than 10 mPa·s in melt viscosity at 140° C. and higher than 75% and not higher than 85% in degree of crystallinity; and the second wax is not higher than 1.5 in ratio of weight average molecular weight (Mw) to number average molecular weight (Mn), lower than 10 mPa·s in melt viscosity at 140° C. and higher than 85% and not higher than 95% in degree of crystallinity.

2. The electrostatic image developing toner according to claim 1, wherein the first wax is higher than 4 mPa·s and lower than 10 mPa·s in melt viscosity at 140° C.; and the second wax is higher than 0.5 mPa·s and lower than 10 mPa·s in melt viscosity at 140° C.

3. The electrostatic image developing toner according to claim 1, wherein the fixing resin is vinyl-based copolymer, containing vinyl-based copolymer polymerized in the presence of at least a part of the hydrocarbon-based wax.

4. The electrostatic image developing toner according to claim 1, wherein melting start temperature (Tfb) of the toner has a relationship of Tmp<Tfb<110° C. to a melting point (Tmp) corresponding to a maximum value of endothermic peaks attributed to the wax on a heat absorption curve during temperature rise in DSC curves of the toner measured by a differential scanning calorimeter; and a glass transition point (Tg) of said toner is beyond 50° C.

5. An image forming method having an electrostatic image recording process comprising:

visualizing an electrostatic latent image formed on an electrostatic image holding member by use of a two-component developer composed of toner and carrier;

transferring the visualized toner image onto a recording medium;

cleaning up a residual toner image on said electrostatic image holding member; and fixing the toner image transferred on the recording medium so as to obtain a recorded image;

wherein the toner is an electrostatic image developing toner comprising at least fixing resin and wax;

the wax is hydrocarbon-based wax, containing, as its constitutional components, first wax and second wax;

the first wax is higher than 1.5 in ratio of weight average molecular weight (Mw) to number average molecular weight (Mn), lower than 10 mPa·s in melt viscosity at 140° C. and higher than 75% and not higher than 85% in degree of crystallinity; and the second wax is not higher than 1.5 in ratio of weight average molecular weight (Mw) to number average molecular weight (Mn), lower than 10 mPa·s in melt viscosity at 140° C. and higher than 85% and not higher than 95% in degree of crystallinity.

6. The image forming method according to claim 5, wherein contact heating fixation is used in said fixing step.

* * * * *